US008081136B2

(12) United States Patent
Yung et al.

(10) Patent No.: US 8,081,136 B2
(45) Date of Patent: Dec. 20, 2011

(54) DUAL-BAND ANTENNA

(75) Inventors: Huang Chih Yung, Dongshih Township, Taichung County (TW); Luo Guo Chang, Toufen Township, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 492 days.

(21) Appl. No.: 12/317,545

(22) Filed: Dec. 24, 2008

(65) Prior Publication Data

US 2010/0156746 A1 Jun. 24, 2010

(30) Foreign Application Priority Data

Sep. 9, 2008 (TW) ..... 97134611 A

(51) Int. Cl.
*H01Q 1/50* (2006.01)

(52) U.S. Cl. ..... 343/860; 343/702; 343/914; 343/895

(58) Field of Classification Search ..... 343/700 MS, 343/702, 895, 746, 914, 860
See application file for complete search history.

(56) References Cited

U.S. PATENT DOCUMENTS 5,448,252 A * 9/1995 Ali et al. ..... 343/700 MS
6,300,909 B1 * 10/2001 Tsubaki et al. ..... 343/700 MS
6,323,811 B1 * 11/2001 Tsubaki et al. ..... 343/700 MS
6,946,994 B2 * 9/2005 Imaizumi et al. ..... 343/700 MS
6,958,730 B2 * 10/2005 Nagumo et al. ..... 343/702

* cited by examiner

*Primary Examiner* — Jacob Y Choi
*Assistant Examiner* — Shawn Buchanan
(74) *Attorney, Agent, or Firm* — Haverstock & Owens LLP

(57) ABSTRACT

The dual-band antenna is provided. The dual-band antenna includes an impedance matching control element, a first connection part, a first radiation element, a second radiation element, and a ground element. The first radiation element operates in a first frequency band, is connected to the impedance matching control element, and extends along a first direction having an obtuse angle with respect to a longitudinal direction of the first connection part. The second radiation element operates in a second frequency band. The ground element is electrically connected to the impedance matching control element and the second radiation element.

19 Claims, 12 Drawing Sheets

| | E-Total | H-pol | V-pol |
|---|---|---|---|
| Peak Gain(dB) | 0.56 | -0.57 | -3.93 |
| Average Gain(dB) | -2.97 | -5.22 | -7.18 |

| | E-Total | H-pol | V-pol |
|---|---|---|---|
| Peak Gain(dB) | 1.47 | -0.60 | -2.85 |
| Average Gain(dB) | -2.35 | -4.94 | -6.10 |

| | E-Total | H-pol | V-pol |
|---|---|---|---|
| Peak Gain(dB) | 1.67 | -0.25 | -1.58 |
| Average Gain(dB) | -2.09 | -5.02 | -5.35 |

| | E-Total | H-pol | V-pol |
|---|---|---|---|
| Peak Gain(dB) | 1.23 | -0.01 | -2.84 |
| Average Gain(dB) | -2.53 | -5.08 | -6.31 |

| | E-Total | H-pol | V-pol |
|---|---|---|---|
| Peak Gain(dB) | -0.28 | -1.41 | -3.86 |
| Average Gain(dB) | -3.54 | -5.69 | -8.02 |

| | E-Total | H-pol | V-pol |
|---|---|---|---|
| Peak Gain(dB) | -0.49 | -3.92 | -0.73 |
| Average Gain(dB) | -4.05 | -7.96 | -6.67 |

| | E-Total | H-pol | V-pol |
|---|---|---|---|
| Peak Gain(dB) | 1.27 | -3.52 | 0.62 |
| Average Gain(dB) | -3.23 | -7.91 | -5.31 |

| | E-Total | H-pol | V-pol |
|---|---|---|---|
| Peak Gain(dB) | -0.51 | -5.28 | -1.59 |
| Average Gain(dB) | -4.02 | -8.52 | -6.13 |

| | E-Total | H-pol | V-pol |
|---|---|---|---|
| Peak Gain(dB) | -1.16 | -4.36 | -1.44 |
| Average Gain(dB) | -4.31 | -8.61 | -6.49 |

| | E-Total | H-pol | V-pol |
|---|---|---|---|
| Peak Gain(dB) | -0.97 | -2.49 | -2.28 |
| Average Gain(dB) | -3.63 | -7.23 | -6.25 |

DUAL-BAND ANTENNA

FIELD OF THE INVENTION

The invention relates to an antenna, and more particularly to a three-dimensional dual-band antenna.

BACKGROUND OF THE INVENTION

With the development of novel technology, various miniaturized handheld electrical apparatuses or wireless communication devices, such as mobile phones, laptop computers, personal digital assistants (PDAs), or wireless AP stations, are gradually popularized. To perform the wireless communication of the above handheld products, various small-sized antennas with good wireless communication performance are developed in order to operate under the standards for various different frequencies, such as IEEE 802.11a working at 5 GHz, IEEE 802.11b/g working at 2.4 GHz, IEEE 802.11n working at 5 and/or 2.4 GHz, Bluetooth working at 2.4 GHz and Worldwide Interoperability for Microwave Access (WiMAX) mainly working at 2.3, 2.5 and 3.5 GHz.

To meet the above demands, various different types of miniaturized antennas have been improved in the recent years. Although the improved antennas are able to operate at the above different frequencies and achieve high gain and optimal directivity, it is still expected to better strengthen structure solidity against the external force.

For example, the dual-band dipole antenna disclosed in U.S. Pat. No. 7,230,578 B2 controls the frequencies by the extending portions, the structure of which lacks support and may be deformed due to the external force although it is simple in structure and easy to be manufactured. The multi-mode and multi-band antenna with a combination of a helical and a pole antennas disclosed in U.S. Pat. No. 7,262,738 B2 enables the combination antenna to be tuned to three or more resonant frequencies, but it is concerned that the coil sections may be compressed by the external force and have negative impact on the working frequencies. The monopole-type antenna for multi- or wide-band use disclosed in U.S. Pat. No. 7,242,352 B2 has a feed conductor and bridge conductor respectively connected to two different top loading elements in order to produce two resonance modes, such that the antenna is applicable in a limited space and easy to be assembled. However, it is still concerned that the antenna with the elongated conductors is easy to be destroyed by the external force and has unstable assembling.

Conventional planar inverted-F antennas (PIFAs) have compact structure and good communication performance, such that they are widely applied to the wireless communication in various handheld electrical devices. In the conventional art, the coaxial cable for signal transmission has a core conductor and an external conductor respectively soldered to the feed point and the ground portion, so that the signal is thereby transmitted from a PIFA. However, the impedance matching and the frequency resonance of the antenna are impacted. Even an improved PIFA for solving the above mentioned problem, such as the dual-band antenna disclosed in U.S. Pat. No. 7,230,573 B2, still has extensive structures of radiation element portions, which lacks well support in structure, such that the configuration of the antenna is easy to be deformed due to the external force and not suitable for a portable communication device in a long term.

To meet business or entertainment demands, an user normally carries a handheld device in different occasions, so that the device is often impacted by the external force. Therefore, the above miniaturized antennas are not solid enough to avoid damages therefrom, and the signal transmitting/receiving performance may be influenced. Moreover, it is expected to make more efforts in achieving miniaturization of the antenna.

Therefore, to overcome the drawbacks from the prior art and to meet the present needs, the Applicant dedicated in considerable experimentation and research, and finally accomplishes the "dual-band antenna" of the present invention, which not only overcomes the above drawbacks regarding damages due to the external force but also present the space saving three-dimensional structure while still achieving good communication. The invention is briefly described as follows.

SUMMARY OF THE INVENTION

To solve the problems in the prior art, the invention provides a dual-band antenna. The dual-band antenna of the present invention is basically presented as a three-dimensional antenna structure made of metal, preferably iron, utilizing different pathways of feeding RF (Radio Frequency) signals to achieve the resonance of dual frequencies. In particular, the dual-band antenna of the present invention is a dual-band antenna in three dimensions having extending structures along directions with angles, such that the dual-band antenna confined in a limited space is capable of operating at demanded frequencies with the required bandwidths and strengthened in structure solidity against the external force without trading off the efficient adjustment for impedance matching for maintaining high communication performance. Therefore, it is suitable for the handheld electrical device such as a laptop computer.

In accordance with one aspect of the present invention, the dual-band antenna is provided. The dual-band antenna comprises an impedance matching control element, a first connection part, a first radiation element, a second radiation element, and a ground element. The first radiation element operates in a first frequency band, is connected to the impedance matching control element, and extends along a first direction having an obtuse angle with respect to a longitudinal direction of the first connection part. The second radiation element operates in a second frequency band. The ground element is electrically connected to the impedance matching control element and the second radiation element.

In accordance with another aspect of the present invention, a dual-band antenna is provided. The dual-band antenna comprises an impedance matching control element, a first radiation element, a second radiation element, a ground element, a first connection part, and a second connection part. The impedance matching control element comprises a first end and a second end. The first radiation element operates in a first frequency band, is electrically connected to the first end via the first connection part, and extends along a first direction having an obtuse angle with respect to a longitudinal direction of the first connection part. The second radiation element operates in a second frequency band, is electrically connected to the second end via the second connection part, and comprises a first extension part extending along a second direction having an obtuse angle with respect to a longitudinal direction of the second connection part. The ground element is electrically connected to the impedance matching control element and the second radiation element.

Preferably, the dual-band antenna consists essentially of a conductive material.

Preferably, the first radiation element, the second radiation element and the impedance matching control element are parallel to each other.

Preferably, the first radiation element, the second radiation element and the impedance matching control element are configured substantially in a plane, and the ground element comprises the second connection part, extends along a direction perpendicular to the plane and has an L-shaped configuration.

Preferably, the dual-band antenna further comprises a connection element, wherein the first radiation element, the second radiation element and the impedance matching control element are configured substantially in a plane, the connection element comprises the first connection part, electrically connects to the first radiation element and the impedance matching control element, extends along a direction perpendicular to the plane and has a specific height, and a bandwidth of the first frequency band is adjusted by the specific height.

Preferably, the dual-band antenna further comprises a connection element, wherein the first radiation element, the second radiation element and the impedance matching control element are configured substantially in a plane, the connection element electrically connects to the first radiation element and the impedance matching control element, extends along a direction perpendicular to the plane and has an L-shaped configuration having a total length, and a bandwidth of the first frequency band is adjusted by the total length.

Preferably, the first radiation element and the impedance matching control element form a first slot therebetween and having a width, an open end and a close end configured at the first connection part, the width is for adjusting impedance matching of the dual-band antenna, and the second radiation element and the impedance matching control element form a second slot therebetween and having a width, an open end and a close end configured at the second connection part.

Preferably, the first radiation element has a stairs-like edge adjacent to the first slot for adjusting an impedance matching of the first radiation element.

Preferably, the second radiation element and the impedance matching control element forms a second slot therebetween and having a width, an open end and a close end configured at the second connection part.

Preferably, the first radiation element has a terminal comprising a bending part having a specific height, and the first frequency band and a starting frequency thereof are adjusted by the specific height.

Preferably, the second radiation element further comprises a second extension part adjacent to the ground element and electrically connected to the first extension part to form an acute-angled slot between the first extension part and the second extension part.

Preferably, the first extension part has a terminal comprising a bending part having a total length, and the second frequency band and a starting frequency thereof are adjusted by the total length.

Preferably, the impedance matching control element is shaped as a strip having a width for adjusting impedance matching of the dual-band antenna.

Preferably, the dual-band antenna further comprises a feeding part connected to the impedance matching control element and feeding a signal thereto.

Preferably, the dual-band antenna further comprises a conductive metal film connected to the ground element.

In accordance with further aspect of the present invention, a dual-band antenna is provided. The dual-band antenna comprises an impedance matching control element, a first radiation element, a second radiation element, a ground element, a first connection part, and a second connection part. The impedance matching control element comprises a first end and a second end. The first radiation element operates in a first frequency band, is electrically connected to the first end via the first connection part, and extends along a first direction having an obtuse angle with respect to a longitudinal direction of the first connection part, in which the first radiation element and the impedance matching control element form a first slot therebetween and having a close end configured at the first connection part. A second radiation element operates in a second frequency band and comprises a first extension part electrically connected to the second end via the second connection part and extends along a second direction having an obtuse angle with respect to a longitudinal direction of the second connection part, in which the second radiation element and the impedance matching control element form a second slot therebetween and having a close end configured at the second connection part. The ground element electrically is connected to the impedance matching control element and the second radiation element.

Preferably, the second radiation element further comprises a second extension part electrically connected to the first extension part and forming an acute-angled slot between the second extension part and the first extension part, and the first slot and the second slot have respective open ends.

Preferably, the first radiation element, the second radiation element and the impedance matching control element are parallel to each other, the impedance matching control element is shaped as a strip having a width for adjusting impedance matching of the dual-band antenna.

Preferably, the first radiation element, the second radiation element and the impedance matching control element are configured substantially in a plane, and the ground element comprises the second connection part, extends along a direction perpendicular to the plane and has an L-shaped configuration.

Preferably, the dual-band antenna further comprises a connection element, wherein the first radiation element, the second radiation element and the impedance matching control element are configured substantially in a plane, the connection element comprises the first connection part, electrically connects to the first radiation element and the impedance matching control element, extends along a direction perpendicular to the plane and has an L-shaped configuration having a total length, and a bandwidth of the first frequency band is adjusted by the total length.

The above aspects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1A:
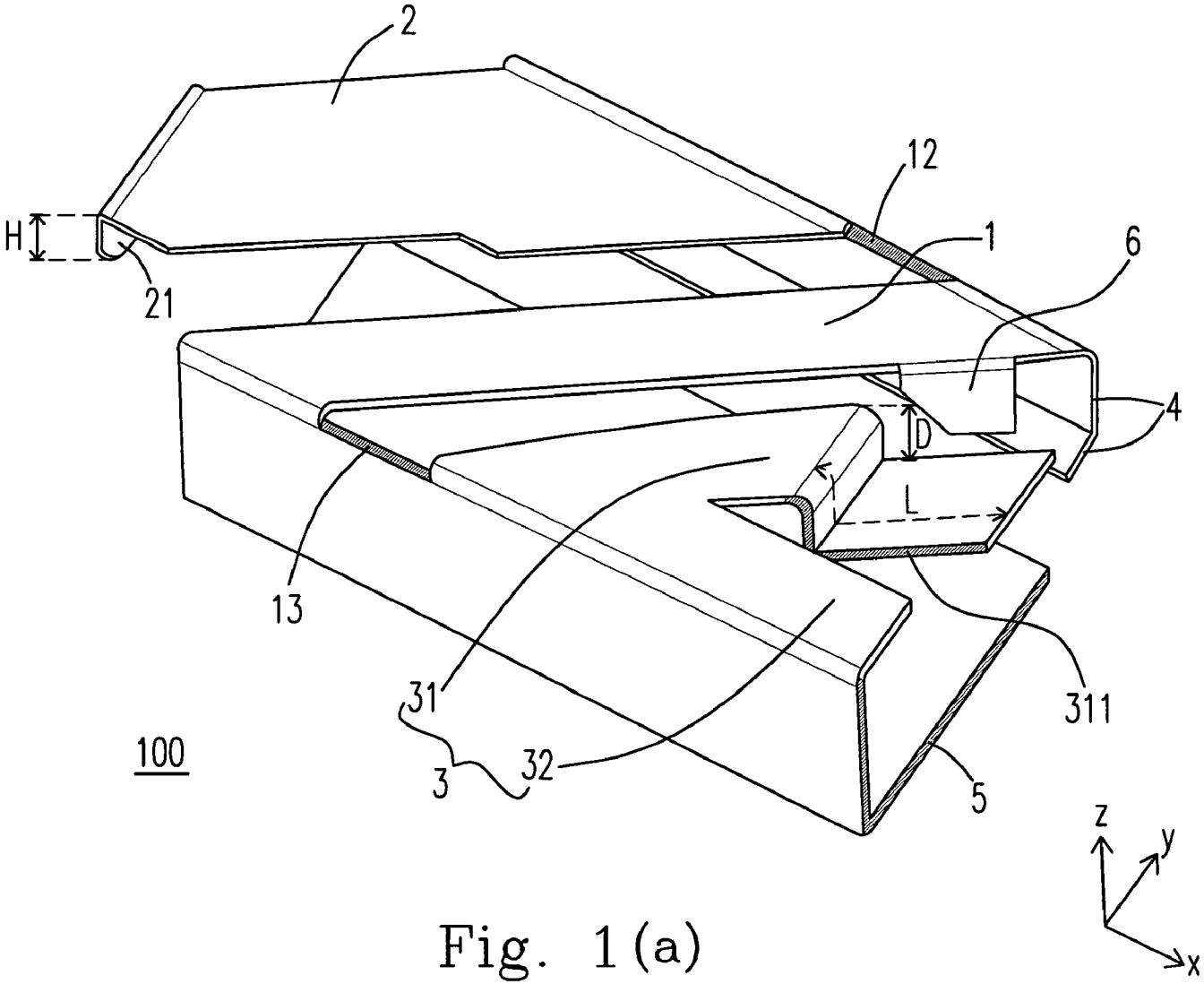
FIG. 1(*a*) to (*b*) are perspective views and (*c*) is a top view of the dual-band antenna 100 according to a first preferred embodiment of the present invention, in which the antenna is basically devised for cable output in a lateral direction (X direction)
Figure 1B:
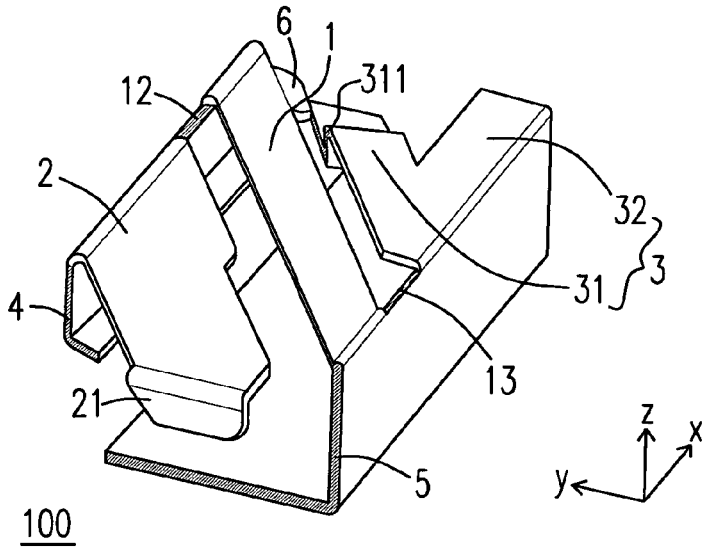
Figure 1C:
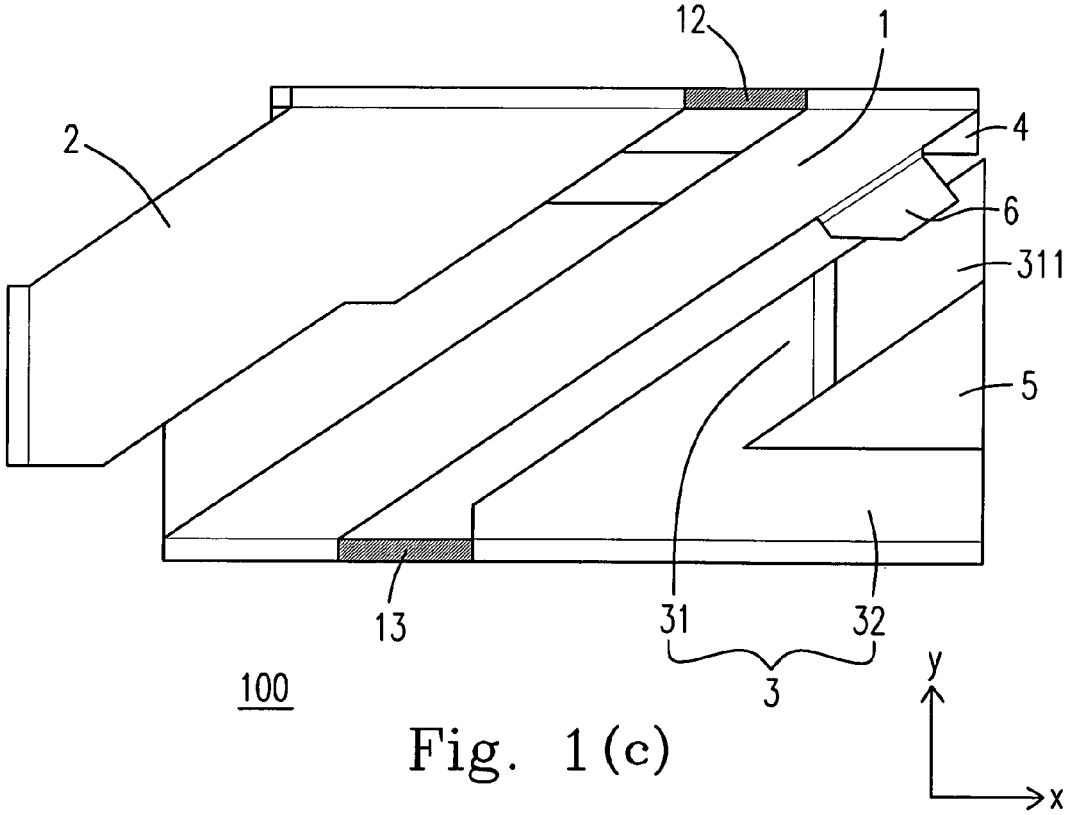
Figure 2A:
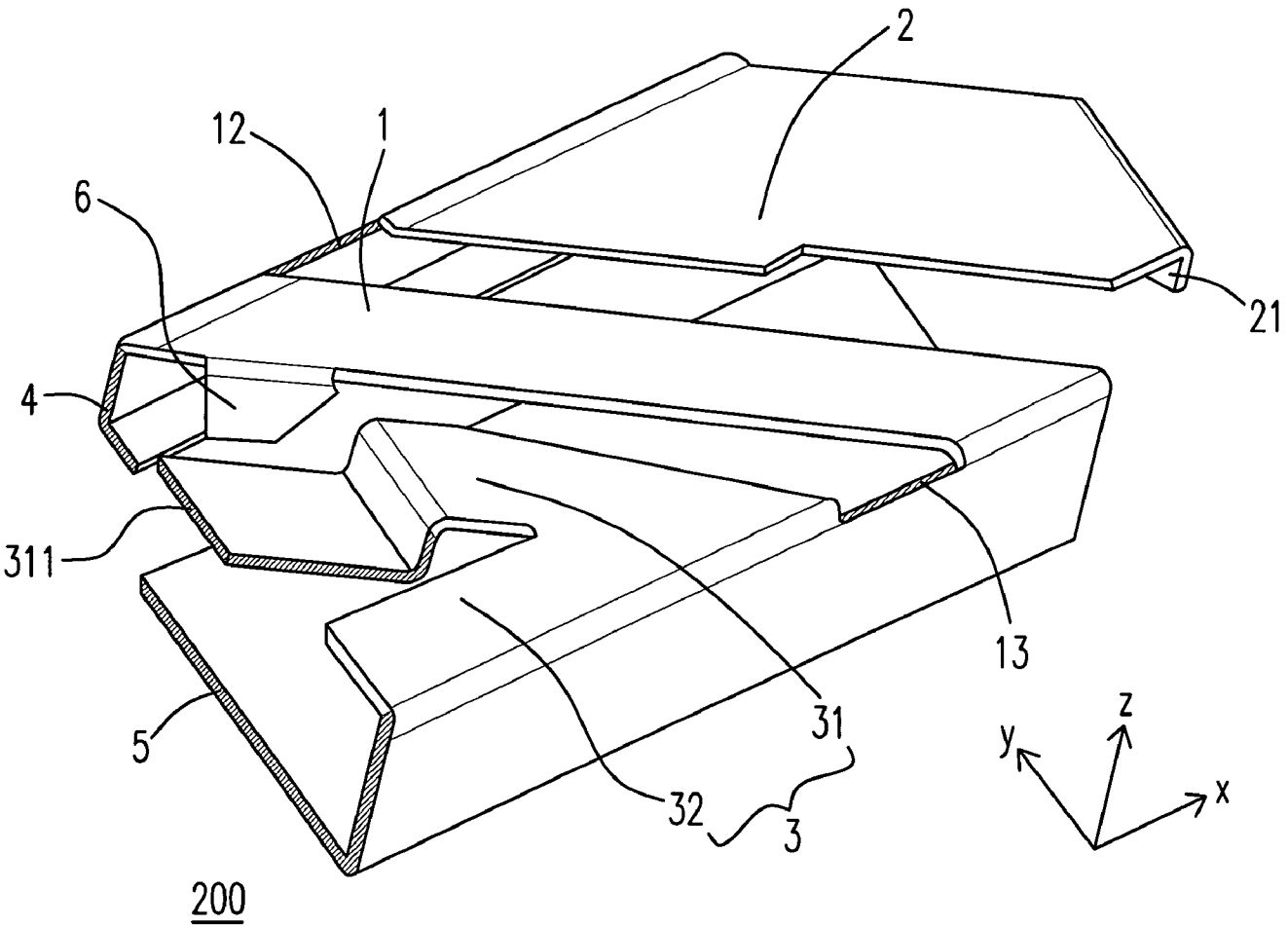
FIG. 2(*a*) to (*b*) are perspective views and (*c*) is a top view of the dual-band antenna 200 according to a second preferred embodiment of the present invention, in which the antenna is presented in mirror-imaged structure with respect to the first preferred embodiment, basically devised for cable output in an opposite lateral direction (−X direction)
Figure 2B:
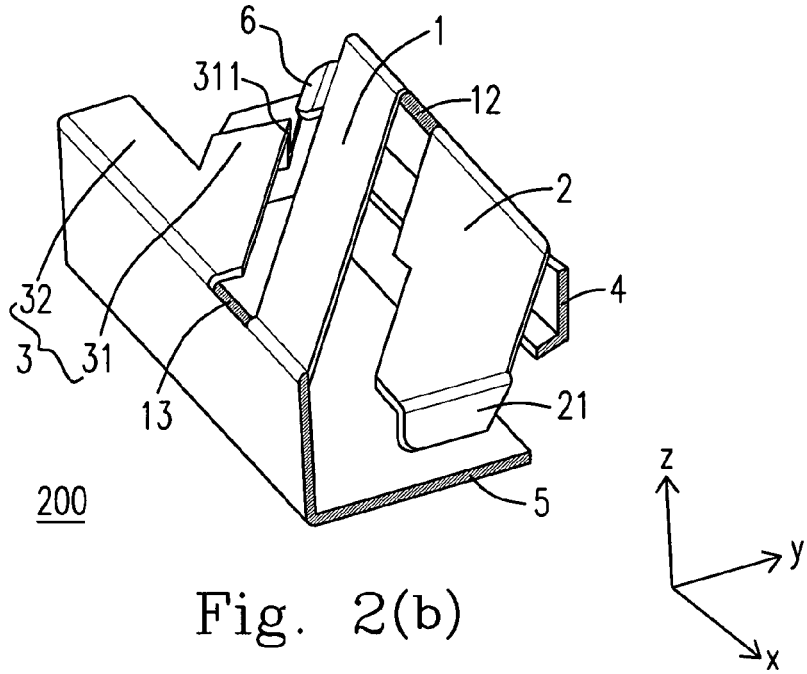
Figure 2C:
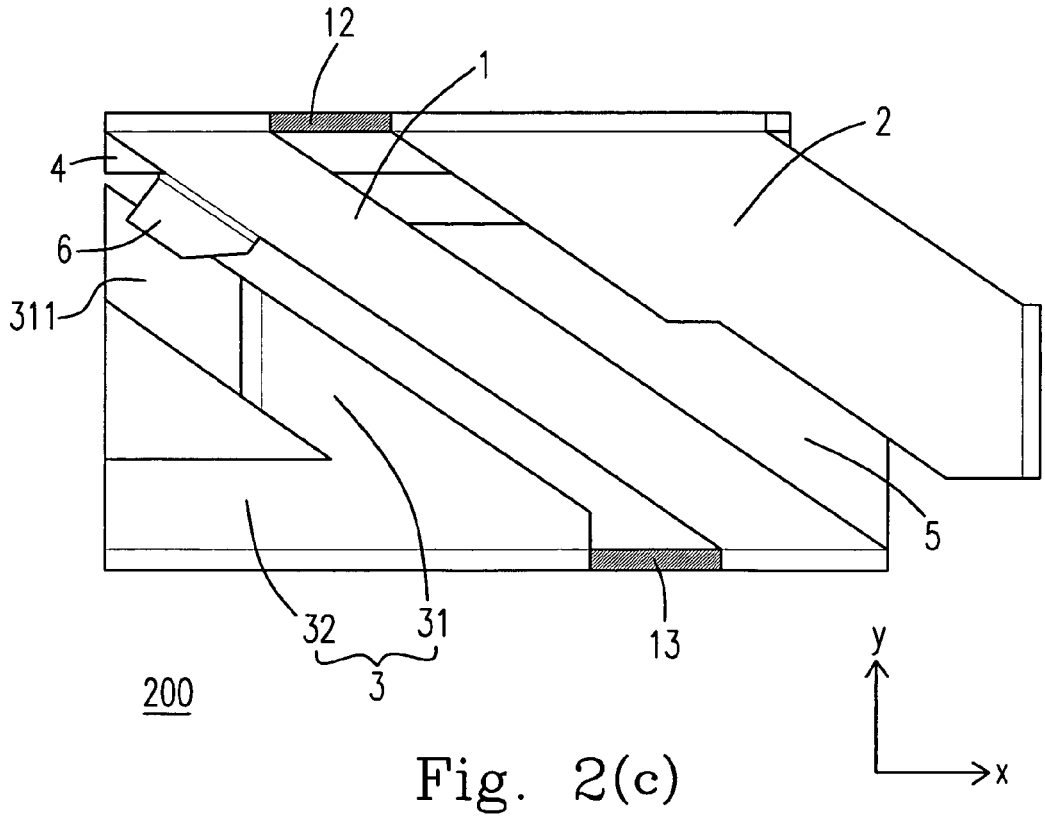
Figure 3A:
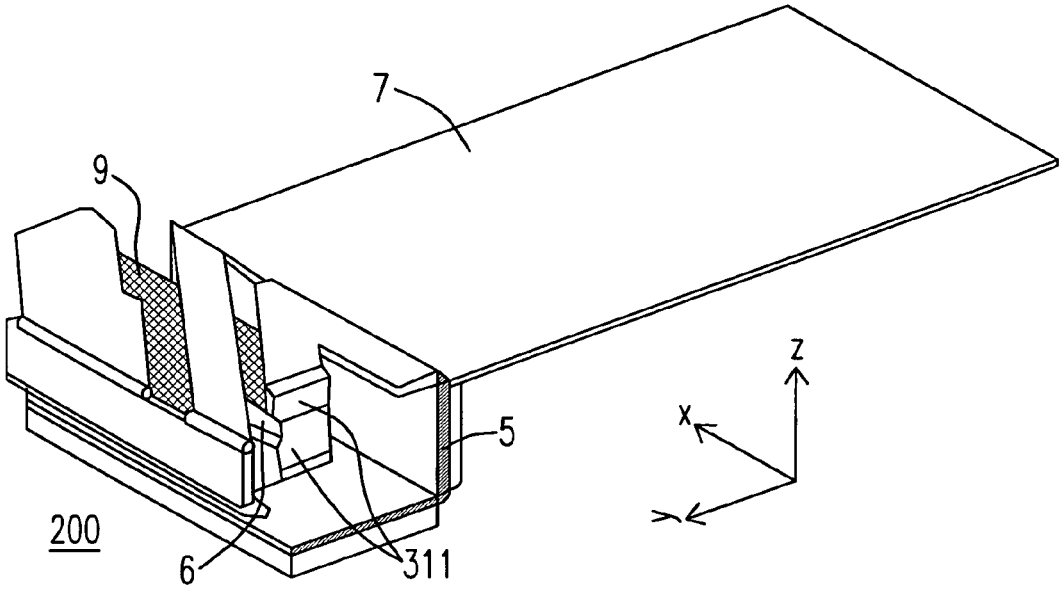
FIGS. 3(*a*) and (*b*) are perspective views of the dual-band antenna 200 according to a second preferred embodiment of the present invention.
Figure 3B:
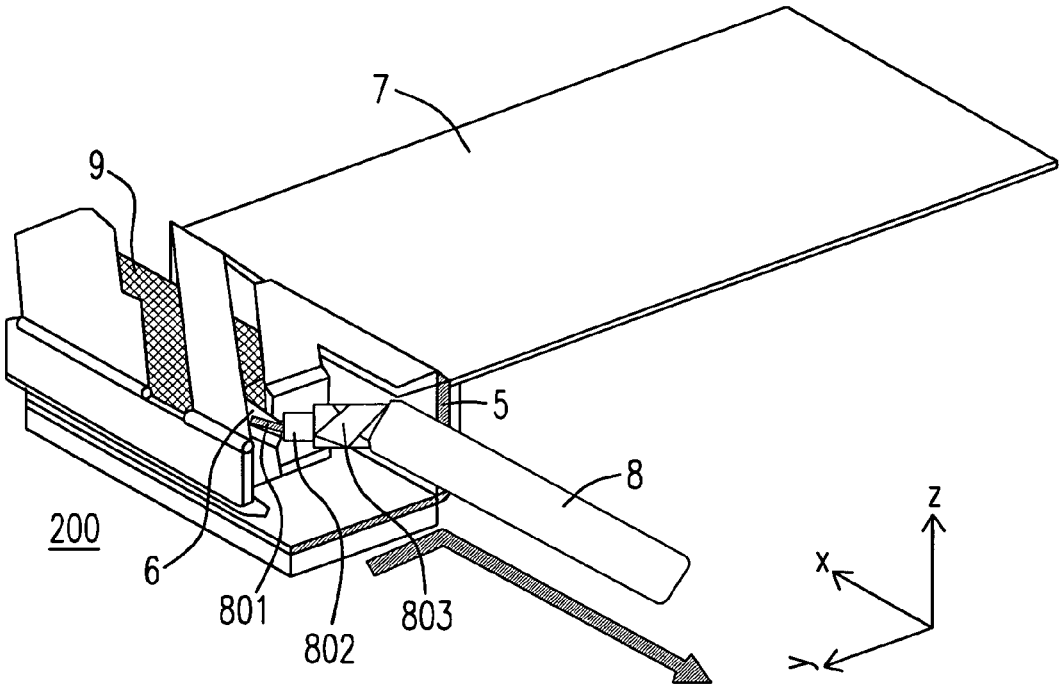

FIGS. 1 to 3 represent perspective views of the dual-band antenna according to preferred embodiments of the present invention. To enable a person having an ordinary skill in the art to better understand the three dimensional structure of the dual-band antenna of the present invention by referring to FIGS. 1 to 3, the arrows x, y and z respectively depicts different dimensional directions in the format of 3D Cartesian Coordinates. It is established that the directions indicated by x, y and z are positive, and that the directions opposite to x, y and z are negative. Thus, the directions opposite to those pointed by arrows x, y and z are represented by −x, −y and −z.

FIG. 1(*a*) to (*b*) are perspective views and (*c*) is a top view of the dual-band antenna 100 according to a first preferred embodiment of the present invention, in which the antenna is basically devised for cable output in a lateral direction (X direction). FIG. 1(*a*) is a first perspective view of the dual-band antenna according to a first preferred embodiment viewed; FIG. 1(*b*) is a second perspective view of the dual-band antenna according to a first preferred embodiment; and FIG. 1(*c*) is a top view of the dual-band antenna according to a first preferred embodiment.

FIG. 2(*a*) to (*b*) are perspective views and (*c*) is a top view of the dual-band antenna 200 according to a second preferred embodiment of the present invention, in which the antenna is presented in mirror-imaged structure with respect to the first preferred embodiment, basically devised for cable output in an opposite lateral direction (−X direction). FIG. 2(*a*) is a first perspective view of the dual-band antenna according to a first preferred embodiment; FIG. 2(*b*) is a second perspective view of the dual-band antenna according to a first preferred embodiment from a second direction; and FIG. 2(*c*) is a top view of the dual-band antenna according to a first preferred embodiment.

Referring to FIGS. 1 to 2, the dual-band antenna 100 or 200 basically comprises an impedance matching control element 1, a first radiation element 2 and a second radiation element 3. Among these, the impedance matching control element 1 is employed for adjusting impedance matching of the antenna so as to eliminate the return loss caused by impedance mismatching. The first radiation element 2 is employed for operating in a first frequency band, particularly a lower frequency band. The second radiation element 3 is employed for operating in a second frequency band, particularly a higher frequency band, in which the second radiation element 3 includes a first extension part 31 and a second extension part 32.

Preferably, the antenna consists essentially of a conductive material, preferably a metal, more preferably iron. Preferably, the first radiation element 1, the second radiation element 2 and the impedance matching control element 3 are parallel to each other. Preferably, the first radiation element 1, the second radiation element 2 and the impedance matching control element 3 are configured substantially in a plane.

Among these, the impedance matching control element 1 includes a first end and a second end respectively electrically connected to the first radiation element 2 and the second radiation element 3.

Preferably, the dual-band antenna 100 or 200 further includes a connection element 4 electrically connected to the first radiation element 2 and the first end of the impedance matching control element 1, in which the connection element 4 extends along a direction perpendicular to the plane (i.e. the plane in which the impedance matching control element 1, the first radiation element 2 and the second radiation element 3 are configured). As shown in FIG. 1, the connection element 4 is extended toward direction −z, in which the bandwidth of the first frequency band is adjusted by the specific extended height. Preferably, after the connection element 4 is extended toward direction −z, it is bent toward direction −y with respect to the plane, and thus the connection element 4 has a substantially L-shaped configuration having a total length capable of adjusting a bandwidth of the first frequency band.

Preferably, the dual-band antenna 100 or 200 further includes a ground element 5 electrically connected to the impedance matching control element 1 and the second radiation element 3. The ground element 5 is extended along direction −z that is perpendicular to the plane (i.e. the plane in which the impedance matching control element 1, the first radiation element 2 and the second radiation element 3 are configured) and then bent toward direction y with respect to the plane, in order to increasingly support the structure and maintain high gain of the dual-band antenna of the present invention.

Preferably, the dual-band antenna 100 or 200 has a first connection part 12. The first radiation element 2 operates in a first frequency band, and is electrically connected to the first end of the impedance matching control element 1 via the first connection part 12. Preferably, the first connection part 12 in the connection element 4 can be formed as a linear line and interconnects the impedance matching control element 1 and the first radiation element 2. The first radiation element 2 is preferably extended along a first direction, in which the first direction has an obtuse angle (more than 90 degree and less than 180 degree) with respect to a longitudinal direction of the first connection part 12, thereby the extension length determines the operating frequency range of the first frequency band.

Preferably, the dual-band antenna 100 or 200 has a second connection part 13. The second radiation element 3 operates in a second frequency band, and is electrically connected to the second end of the impedance matching control element 1 via the second connection part 13. Preferably, the second connection part 13 in the ground element 5 can be formed as a linear line and interconnects the impedance matching control element 1 and the second radiation element 3. The first extension part 31 of first radiation element 3 is preferably extended along a second direction, in which the second direction has an obtuse angle (more than 90 degree and less than 180 degree) with respect to a longitudinal direction of the second connection part 13, thereby the extension length determines the operating frequency range of the second frequency band.

By means of the above three-dimensional structure with extensions along directions with the above angles, which is mainly presented as a hollow block, it increases the support for the dual-band antenna of the present invention against the external stress as well as achieving the efficacy of operating in dual frequency bands when the antenna is confined in a limited space.

In order to feed RF signals, a feeding part 6 can be electrically connected to the impedance matching control element 1, so that different pathways of RF feeding signals are generated to achieve the resonance of dual frequencies. Preferably, the feeding part 6 is bent in structure and electrically connected to a local edge of impedance matching control element 1. Thereby, the first radiation element 2 mainly operates in a lower frequency band, and the second radiation element 3 mainly operates in a higher frequency band.

In order to control impedance matching of the present dual-band antenna, the present invention can be implemented as follows:

A first slot is formed between the first radiation element 2 and the impedance matching control element 1. The first slot has an open end and a close end, in which the close end is located at the first connection part 12 between the first radiation element 2 and the impedance matching control element 1. The width of the slot is adapted to control impedance matching of the antenna 100 or 200 so as to achieve optimal output VSWR (Voltage Standing Wave Ratio).

A second slot is formed between the second radiation element 3 and the impedance matching control element 1. The second slot has an open end and a close end. The close end is located at the second connection part 13 between the second radiation element 3 and the impedance matching control element 1. The width of the second slot is adapted to control the antenna 100 or 200 so as to achieve optimal output VSWR.

The impedance matching control element 1 is shaped as a strip having a width for adjusting impedance matching of the dual-band antenna so as to achieve optimal output VSWR.

In order to further control radiation performance of the first radiation element 2, the present invention can be implemented as follows:

The first radiation element 2 has a terminal comprising a bending part 21 having a specific height H (see FIG. 1(*a*)), and the first frequency band and a starting frequency thereof are adjusted by the specific height. To meet various demands for different frequency bands in various products, the height is adapted to finely adjust the operating frequency of the first frequency band, particularly the lower frequency band.

The bending part 21 of the first radiation element 2 has substantially trapezoid shaped face, in which the bending side is wider than the end side. The trapezoid shaped face is adapted to control impedance matching of the first radiation element 2 operating at lower frequency so as to achieve optimal output VSWR.

The first radiation element 2 has a stairs-like edge adjacent to the first slot for adjusting impedance matching of the first radiation element operating at lower frequency so as to achieve optimal output VSWR.

In order to further control radiation performance of the second radiation element 3, the present invention can be implemented as follows:

The second extension part 32 of the second radiation element 3 is adjacent to the ground element 5 and electrically connected to the first extension part 31 to form an acute-angled slot (more than 0 degree and less than 90 degree) between the first extension part 31 and the second extension part 32. Depending on the demands for various frequencies in product application, the adaptation of the size of the acute angled slot is able to control the extension length of the first extension part 31 in a confined space, and further control the second frequency band and a starting frequency thereof so as to finely adjust the operating frequency of the second frequency band, particularly the higher frequency band.

The first extension part 31 of the second radiation element 3 has a terminal comprising a bending part 311 having a depth D (see FIG. 1(*a*)) that can adjust the coupling of the second frequency band, particularly the higher frequency band, and control impedance matching of the second frequency band of the second radiation element 3 so as to achieve optimal output VSWR.

Preferably, the bending part 311 extends along a direction perpendicular to the first extension part 31 and then bends along the original extension direction of the first extension part 31. The total length L of the bending part 311 (see FIG. 1(*a*)) is adapted to adjust the second frequency band and the starting frequency thereof. Therefore, to meet demands for various frequencies in product application, the operating frequency of the second frequency band, particularly the higher frequency band, can be finely adjusted thereby.

FIGS. 3(*a*) and (*b*) are perspective views of the dual-band antenna 200 according to a second preferred embodiment of the present invention. Referring FIG. 3, the dual-band antenna of the present invention further comprises a conductive metal film, preferably a ground foil 7, connected to the ground element 5. The conductive metal film is preferably connected to the top side of the ground 5 and horizontally extended so as to achieve good grounding performance.

A cushion material 9, preferably a foam rubber can be placed in the internal space of the antenna in order to support the whole structure of the antenna.

As shown in FIG. 3(*b*), RF signals can be fed by means of a signal feeding cable 8. Preferably, the signal feeding cable 8 can be a coaxial cable having a core conductor 801 for signal feeding, an external conductor 803, and an insulator 802 therebetween. For the signal feeding cable 8, the signal feeding terminal of is electrically connected to the above feeding part 6, and the grounding terminal is electrically connected to the grounding element 5. Preferably, the core conductor 801 at the terminal of the signal feeding cable 8 is soldered onto the feeding part 6. The feeding cable 8 extends out by passing by the bending part 311 of the terminal of the above first extension part 31. After being optimally designed, the bending depth is able to avoid interfering the layout of the signal feeding cable 8. The grounding terminal 803 of the signal feeding cable 8 is connected to the inside of the upright portion of the ground element 5, and the cable 8 exits toward direction −x from the lateral side of the antenna. Thereby, the RF signal feeding pathway for the dual-band antenna is unhindered.

In the dual-band antenna of the present invention, the edge of each element can be varied in shape. For example, depending on the demands for the product application, the elements may have arc edges; depending the convenience in manufacturing, the element edges can also have simple straight angles.

Figure 4:
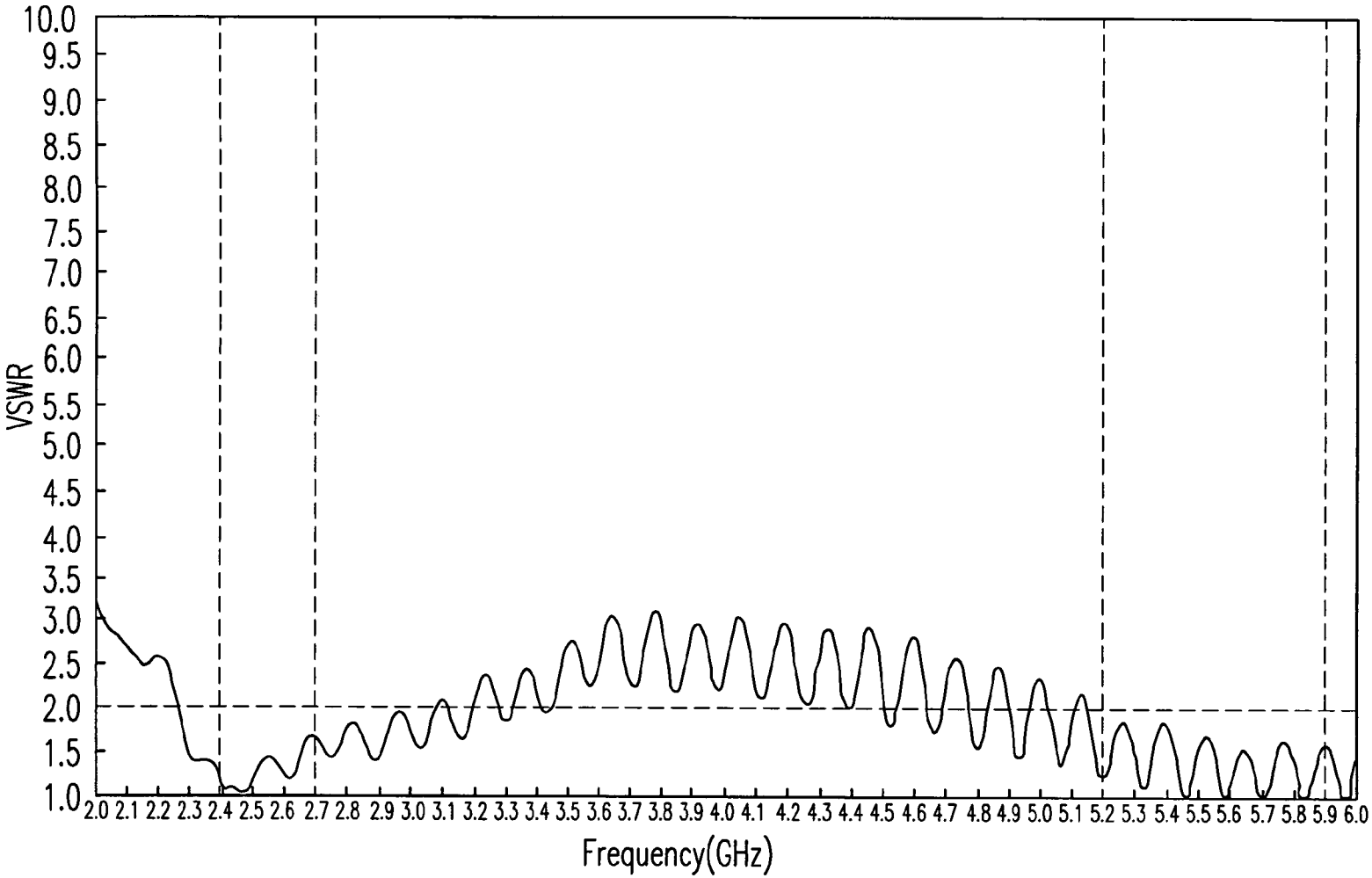
FIG. 4 is a test chart recording to Voltage Standing Wave Radio of the dual-band antenna according to a preferred embodiment of the present invention.
Figure 5A:
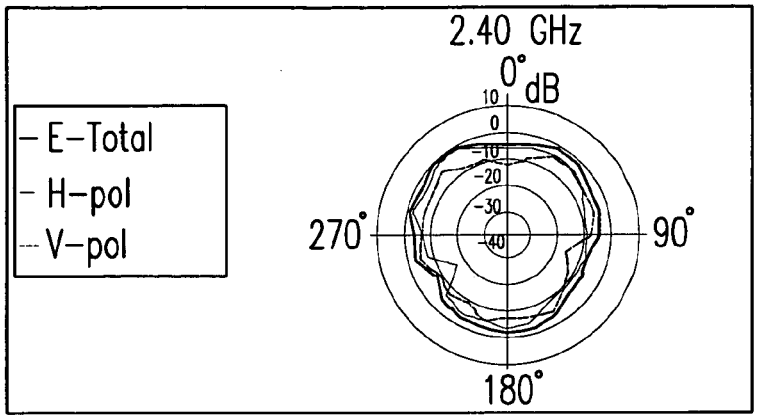
FIG. 5(*a*) to (*e*) are radiation patterns and tables indicating the gains of the dual-band antenna according to a preferred embodiment operating at the frequency of 2.4 GHz to 2.70 GHz.
Figure 5B:
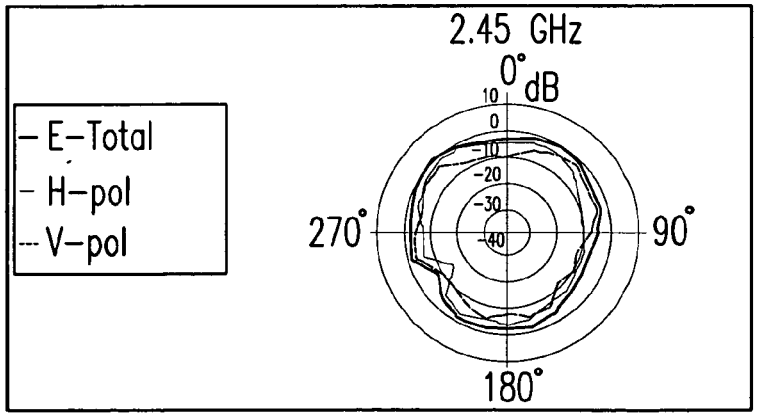
Figure 5C:
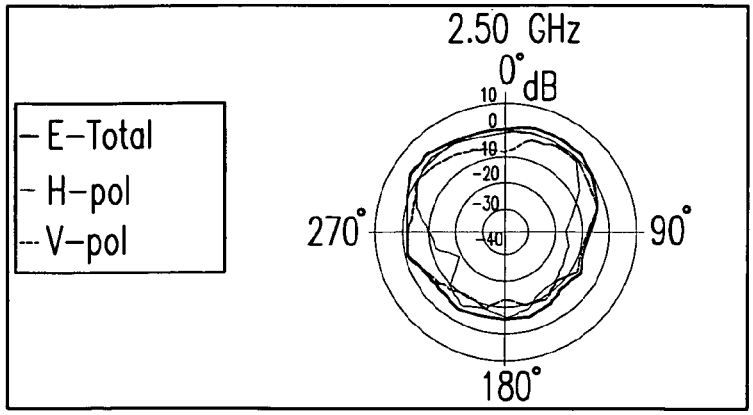
Figure 5D:
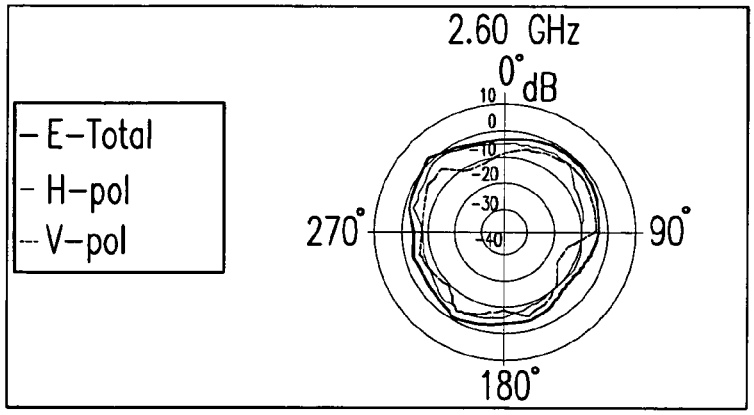
Figure 5E:
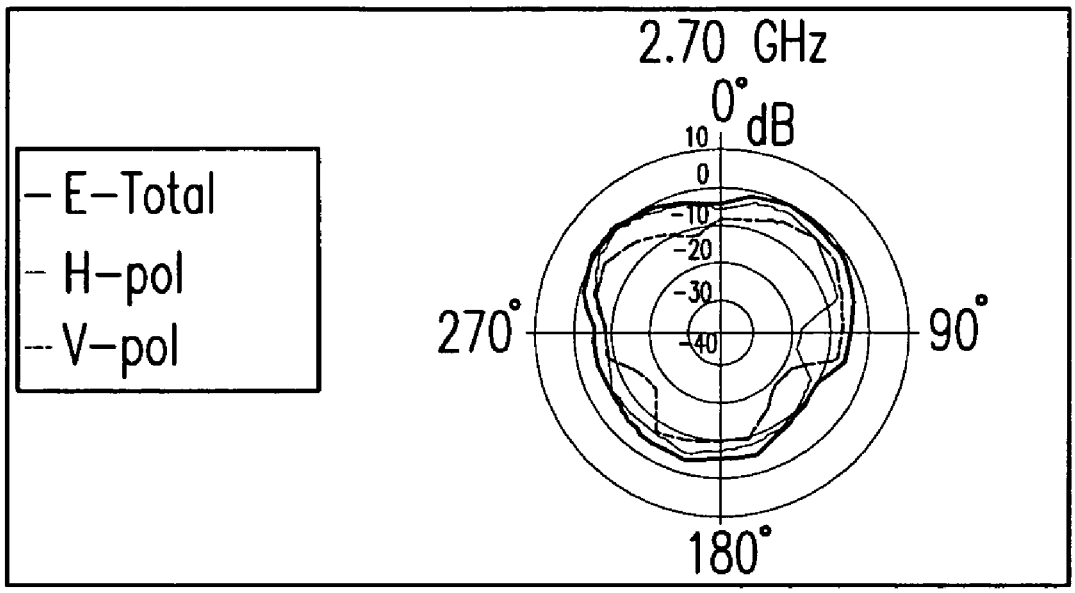
Figure 6A:
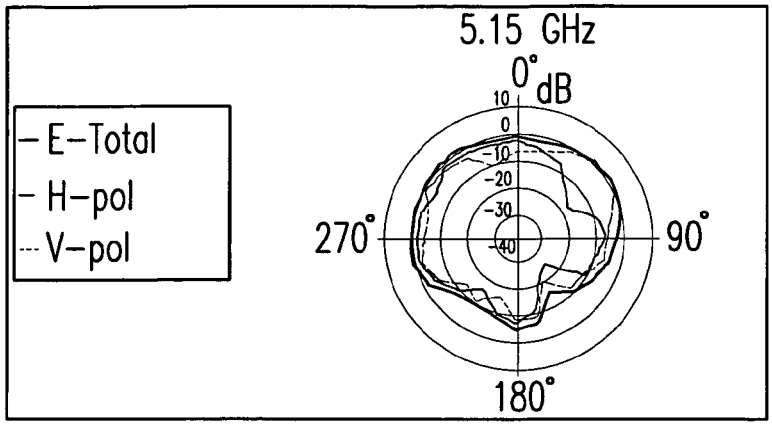
FIG. 6(*a*) to (*e*) are radiation patterns and tables indicating the gains of the dual-band antenna according to a preferred embodiment operating at the frequency of 5.15 GHz to 5.825 GHz.
Figure 6B:
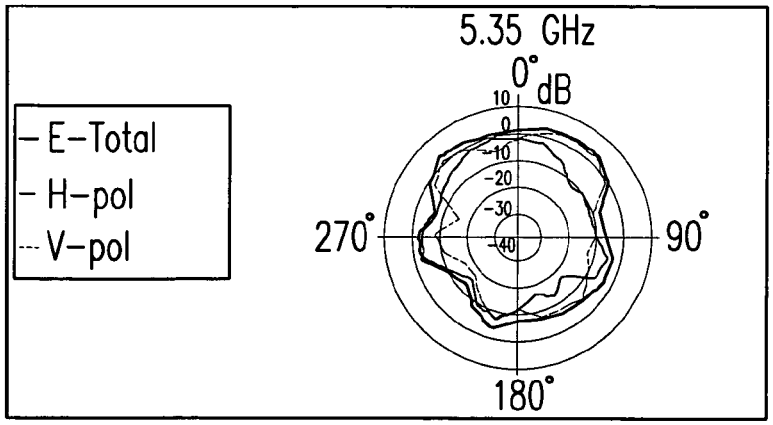
Figure 6C:
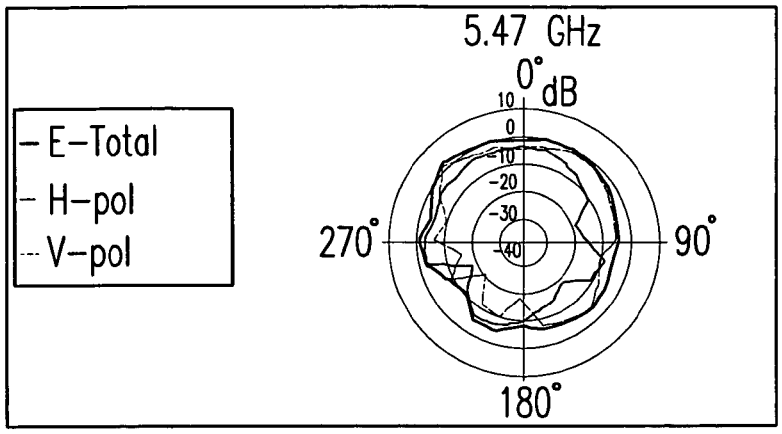
Figure 6D:
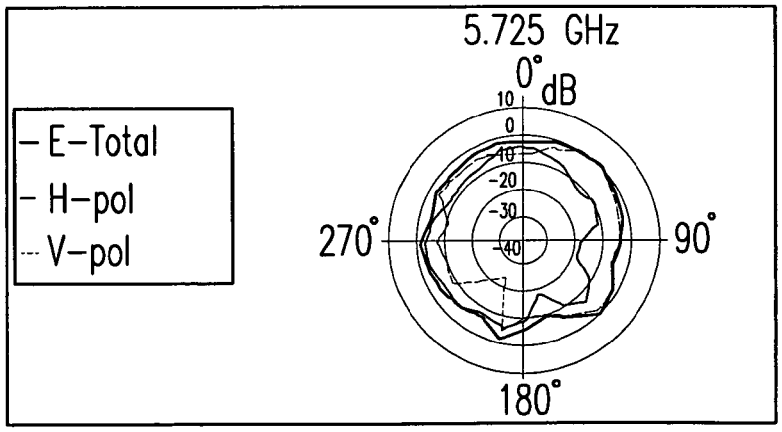
Figure 6E:
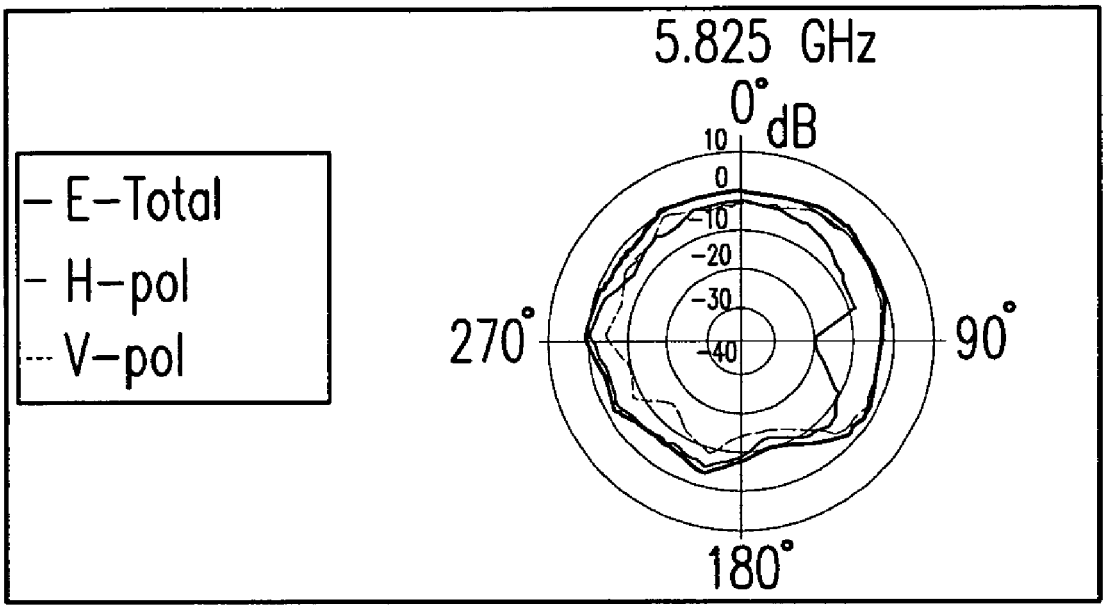

Referring to FIG. 4, it is a test chart recording to Voltage Standing Wave Radio of the dual-band antenna according to a preferred embodiment of the present invention. The VSWR values represent the impedance matching of the antenna. The higher the above values, the higher impedance mismatching, which represents higher return power and causes more return loss. Generally, the quality of the antenna is acceptable when VSWR is lower than 2. Therefore, in light of FIG. 4, it is apparent that the VSWR values drop below 2 when the antenna of the preferred embodiment operates in 2.4 to 2.7 GHz for the lower frequency band and 5.2 to 5.9 GHz for the higher frequency band. Moreover, according to the frequency range with the VSWR values lower than 2, it is apparent that the antenna of the embodiment is able to operate in the lower frequency band with the bandwidth of at least 300 MHz and in the higher frequency band with the bandwidth of up to 1 GHz. Hence, such wireless communications can fully meet the standards under IEEE 802.11a/b/g/n, WiMax and Bluetooth.

FIGS. 5 and 6 are radiation patterns and tables indicating the gains of the dual-band antenna according to a preferred embodiment, in which FIGS. 5(*a*) to (*e*) represent the radiation patterns of operating at the frequency of 2.4 GHz to 2.70 GHz, and FIGS. 6(*a*) to (*e*) represent the radiation patterns of operating at the frequency of 5.15 GHz to 5.825 GHz. In these figures, "E-Total (-)" represents the total radiation pattern of horizontally and vertically polarized of the antenna, "V-pol (-)" represents the vertically polarized principle plane radiation pattern of the antenna, and "H-pol (---)" represents the horizontally polarized principle plane radiation pattern of the antenna. In light of FIGS. 5 and 6, a person having an ordinary skill in the art would know that the dual-band antenna of the present invention still possess good communication performance.

In conclusion, by means of the three-dimensional structure with extensions along certain directions with angles, the dual-band antenna of the present invention can be configured in small size and has strengthened structure. Hence, in a confined space, the antenna is able to adjust the operating frequency band and the bandwidth thereof to meet the requirements and effectively control impedance matching of the antenna, so that the antenna still can achieve good wireless communication performance. Therefore, the dual-band antenna of the present invention is able to be devised as a built-in or a plug-in device, which is particularly suitable for various products with dual-band communications (for example, operating at 2.40 to 2.70 GHz and 5.1 to 5.9 GHz), such as laptop computers, mobile phones, and wireless AP base stations.

Based on the above descriptions, it is understood that the present invention is indeed an industrially applicable, novel and non-obvious one with values in industrial development. While the invention has been described in terms of what are presently considered to be the most practical and preferred embodiments, it is to be understood that the invention should not be limited to the disclosed embodiment. On the contrary, it is intended to cover numerous modifications and variations included within the spirit and scope of the appended claims which are to be accorded with the broadest interpretation so as to encompass all such modifications and variations. Therefore, the above description and illustration should not be taken as limiting the scope of the present invention which is defined by the appended claims.

What is claimed is:

1. A dual-band antenna, comprising:

an impedance matching control element comprising a first end and a second end;

a first connection part;

a first radiation element operating in a first frequency band, electrically connected to the first end via the first connection part, and extending along a first direction having an obtuse angle with respect to a longitudinal direction of the first connection part, wherein the first radiation element and the impedance matching control element form a first slot therebetween and having a close end configured at the first connection part;

a second connection part;

a second radiation element operating in a second frequency band and comprising a first extension part electrically connected to the second end via the second connection part and extending along a second direction having an obtuse angle with respect to a longitudinal direction of the second connection part, and a second extension part electrically connected to the first extension part and forming an acute-angled slot between the second extension part and the first extension part, wherein the second radiation element and the impedance matching control element form a second slot therebetween and having a close end configured at the second connection part; and a ground element electrically connected to the impedance matching control element and the second radiation element.

2. The dual-band antenna as claimed in claim 1, wherein the first slot and the second slot have respective open ends.

3. The dual-band antenna as claimed in claim 1, wherein the first radiation element, the second radiation element and the impedance matching control element are parallel to each other, the impedance matching control element is shaped as a strip having a width for adjusting impedance matching of the dual-band antenna.

4. The dual-band antenna as claimed in claim 1, wherein the first radiation element, the second radiation element and the impedance matching control element are configured substantially in a plane, and the ground element comprises the second connection part, extends along a direction perpendicular to the plane and has an L-shaped configuration.

5. The dual-band antenna as claimed in claim 1 further comprising a connection element, wherein the first radiation element, the second radiation element and the impedance matching control element are configured substantially in a plane, the connection element comprises the first connection part, electrically connects to the first radiation element and the impedance matching control element, extends along a direction perpendicular to the plane and has an L-shaped configuration having a total length, and a bandwidth of the first frequency band is adjusted by the total length.

6. A dual-band antenna, comprising:

an impedance matching control element comprising a first end and a second end;

a first connection part;

a first radiation element operating in a first frequency band, electrically connected to the first end via the first connection part, and extending along a first direction having an obtuse angle with respect to a longitudinal direction of the first connection part;

a second connection part;

a second radiation element operating in a second frequency band, electrically connected to the second end via the second connection part, and comprising a first extension part extending along a second direction having an obtuse angle with respect to a longitudinal direction of the second connection part, and a second extension part electrically connected to the first extension part and forming an acute-angled slot between the second extension part and the first extension part; and a ground element electrically connected to the impedance matching control element and the second radiation element.

7. The dual-band antenna as claimed in claim 6, wherein the dual-band antenna consists essentially of a conductive material.

8. The dual-band antenna as claimed in claim 6, wherein the first radiation element, the second radiation element and the impedance matching control element are parallel to each other.

9. The dual-band antenna as claimed in claim 6, wherein the first radiation element, the second radiation element and the impedance matching control element are configured substantially in a plane, and the ground element comprises the second connection part, extends along a direction perpendicular to the plane and has an L-shaped configuration.

10. The dual-band antenna as claimed in claim 6 further comprising a connection element, wherein the first radiation element, the second radiation element and the impedance matching control element are configured substantially in a plane, the connection element comprises the first connection part, electrically connects to the first radiation element and the impedance matching control element, extends along a direction perpendicular to the plane and has a specific height, and a bandwidth of the first frequency band is adjusted by the specific height.

11. The dual-band antenna as claimed in claim 6 further comprising a connection element, wherein the first radiation element, the second radiation element and the impedance matching control element are configured substantially in a plane, the connection element electrically connects to the first radiation element and the impedance matching control element, extends along a direction perpendicular to the plane and has an L-shaped configuration having a total length, and a bandwidth of the first frequency band is adjusted by the total length.

12. The dual-band antenna as claimed in claim 6, wherein the first radiation element and the impedance matching control element form a first slot therebetween and having a width, an open end and a close end configured at the first connection part, the width is for adjusting impedance matching of the dual-band antenna, and the second radiation element and the impedance matching control element form a second slot therebetween and having a width, an open end and a close end configured at the second connection part.

13. The dual-band antenna as claimed in claim 12, wherein the first radiation element has a stairs-like edge adjacent to the first slot for adjusting impedance matching of the first radiation element.

14. The dual-band antenna as claimed in claim 6, wherein the first radiation element has a terminal comprising a bending part having a specific height, and the first frequency band and a starting frequency thereof are adjusted by the specific height.

15. The dual-band antenna as claimed in claim 6, wherein the first extension part has a terminal comprising a bending part having a total length, and the second frequency band and a starting frequency thereof are adjusted by the total length.

16. The dual-band antenna as claimed in claim 6, wherein the impedance matching control element is shaped as a strip having a width for adjusting impedance matching of the dual-band antenna.

17. The dual-band antenna as claimed in claim 6 further comprising a feeding part connected to the impedance matching control element and feeding a signal thereto.

18. The dual-band antenna as claimed in claim 6 further comprising a conductive metal film connected to the ground element.

19. A dual-band antenna, comprising:

an impedance matching control element;

a first connection part;

a first radiation element operating in a first frequency band, connected to the impedance matching control element, and extending along a first direction having an obtuse angle with respect to a longitudinal direction of the first connection part;

a second radiation element operating in a second frequency band and comprising a first extension part and a second extension part electrically connected to the first extension part and forming an acute-angled slot between the second extension part and the first extension part; and a ground element electrically connected to the impedance matching control element and the second radiation element.

* * * * *